US009242265B2

(12) United States Patent
Hedges

(10) Patent No.: US 9,242,265 B2
(45) Date of Patent: Jan. 26, 2016

(54) 3D DISPENSING APPARATUS AND METHOD

(71) Applicant: LITE-ON MOBILE OYJ, Vantaa (FI)

(72) Inventor: Martin Hedges, Nuremberg (DE)

(73) Assignee: LITE-ON MOBILE OYJ, Vantaa (FI)

( * ) Notice: Subject to any disclaimer, the term of this patent is extended or adjusted under 35 U.S.C. 154(b) by 215 days.

(21) Appl. No.: 13/738,287

(22) Filed: Jan. 10, 2013

(65) Prior Publication Data

US 2014/0134333 A1 May 15, 2014

(30) Foreign Application Priority Data

Nov. 12, 2012 (EP) ..... 12192211

(51) Int. Cl.

| | |
|---|---|
| ***B05C 5/00*** | (2006.01) |
| ***B05C 13/00*** | (2006.01) |
| ***B05C 13/02*** | (2006.01) |
| ***B41J 3/407*** | (2006.01) |

(52) U.S. Cl.

CPC ..... *B05C 5/002* (2013.01); *B05C 13/02* (2013.01); *B41J 3/4073* (2013.01)

(58) Field of Classification Search

None

See application file for complete search history.

(56) References Cited

U.S. PATENT DOCUMENTS

| | | | | |
|---|---|---|---|---|
| 2001/0019340 | A1 | 9/2001 | Kubo et al. | |
| 2003/0159651 | A1 | 8/2003 | Sakurada | |
| 2003/0228124 | A1 * | 12/2003 | Renn et al. | 385/147 |
| 2010/0302304 | A1 | 12/2010 | Bauer | |
| 2012/0064237 | A1 | 3/2012 | Nitta et al. | |

FOREIGN PATENT DOCUMENTS

| | | | |
|---|---|---|---|
| EP | 1 479 524 | A1 | 11/2004 |
| EP | 2 179 853 | A1 | 4/2010 |

OTHER PUBLICATIONS

European Search Report issued in European Patent Application No. 12 19 2211 dated Apr. 15, 2013.

* cited by examiner

*Primary Examiner* — Dah-Wei D Yuan
*Assistant Examiner* — Jethro M Pence
(74) *Attorney, Agent, or Firm* — Li&Cai Intellectual Property (USA) Office

(57) ABSTRACT

A 3D dispensing apparatus and method. The apparatus includes a motion platform, at least two dispense heads for dispensing and multiple fixtures for holding articles to be processed simultaneously, a motion control module for automated motions of said dispense heads relative to said fixtures. Said motions includes three orthogonally X-Y-Z arranged linear motions and first and second rotational motions, the rotational axis of the first rotational motion being divergent from the rotational axis of the second rotational motion. The dispense heads or the fixtures are arranged to a slave unit being arranged to realize at least one of said two rotational movements so that the dispense heads or the fixtures therein realize simultaneously and equally said rotational motion.

21 Claims, 6 Drawing Sheets

3D DISPENSING APPARATUS AND METHOD

BACKGROUND

The invention relates to a 3D dispensing apparatus, comprising a motion platform.

The invention further relates to a method for 3D dispensing.

Various functional printing devices such as dispensers, ink jet, aerosol jet and other dispensing, spraying and printing technologies have the potential to print functional inks on three dimensional (3D) substrate surfaces, whereby the dispense head is moved relative to the substrate surface by a computer numerically controlled (CNC) or other motion device, to deposit ink in the pattern required.

Once deposited the inks can be post processed by using methods such as laser light or visible light to heat, dry or sinter the printed trace, or cured using ultra-violet (UV) light or similar processes.

To be able to process on multiple sides or faces of a 3D substrate a multiple axes of motion of print head relative to the article are required. However, currently known arrangements have problems in their capacity.

BRIEF DESCRIPTION

Viewed from a first aspect, there can be provided a 3D dispensing apparatus comprising at least two dispense heads for dispensing and multiple fixtures for holding articles to be pro-cessed simultaneously, a motion control module for automated motions of said dispense heads relative to said fixtures, said motions comprising three orthogonally X-Y-Z arranged linear motions and first and second rotational motions, the rotational axis of the first rotational motion being divergent from the rotational axis of the second rotational motion, the dispense heads or the fixtures being arranged to a slave unit, and the slave unit being arranged to realize at least one of said two rotational movements so that the dispense heads or the fixtures therein realize simultaneously and equally said rotational motion.

Viewed from a further aspect, there can be provided a 3D dispensing method comprising: dispensing simultaneously dispense media on at least two articles by using at least two dispense heads on a motion platform, moving said dispense heads relative to said articles by automatically controlled motions, said motions comprising three orthogonally X-Y-Z arranged linear motions and first and second rotational motions, the rotational axis of the first rotational motion being divergent from the rotational axis of the second rotational motion, and realizing said motions simultaneously and equally for producing said simultaneous dispensing of the dispense media.

The apparatus and method may enable multiple dispense heads to operate simultaneously in full 5 axes of motion in a single motion platform. Further, the apparatus and method may be implemented in a compact system with reduced hardware and/or computer controls with reduced cost and floor space requirements compared to multiple single print head systems of the same total capacity. Still further, tool-path generation and process programming, may be simplified, because one tool-path CAM file drives multiple dispense heads and fixtures in the single system.

The apparatus and the method are characterised by what is stated in the characterising parts of the independent claims. Some other embodiments are characterised by what is stated in the other claims. Inventive embodiments are also disclosed in the specification and drawings of this patent application.

The inventive content of the patent application may also be defined in other ways than defined in the following claims. The inventive content may also be formed of several separate inventions, especially if the invention is examined in the light of expressed or implicit sub-tasks or in view of obtained benefits or benefit groups. Some of the definitions contained in the following claims may then be unnecessary in view of the separate inventive ideas. Features of the different embodiments of the invention may, within the scope of the basic inventive idea, be applied to other embodiments.

In an embodiment, the slave unit is arranged in a master unit support arranged movably in Y-axis direction, the slave unit being adapted to realize the first rotational movement around first rotational axis arranged in X-axis direction, each of the fixtures being arranged to the slave unit rotatable around a second rotational axis of its own, the second rotational axes being parallelly arranged and perpendicular to the first rotational axis, and the dispense heads arranged movably in X-axis and Z-axis directions with respect to the motion platform. An advantage is that the structure is mechanically simple and may give best accuracy and dynamic response. Additionally, the structure may al low unlimited rotation on the multiple B axes. Furthermore, the parts being dispensed may be positionally very close to each other because the dispense heads need not to pass between them during dispensing process. Consequently the structure can be very short in the X direction.

BRIEF DESCRIPTION OF FIGURES

Some embodiments illustrating the present disclosure are described in more detail in the attached drawings, in which FIG. 5*b* is another schematic perspective view of the example slave unit shown in FIG. 5*a*.

In the figures, some embodiments are shown simplified for the sake of clarity. Similar parts are marked with the same reference numbers in the figures.

DETAILED DESCRIPTION

Figure 1:
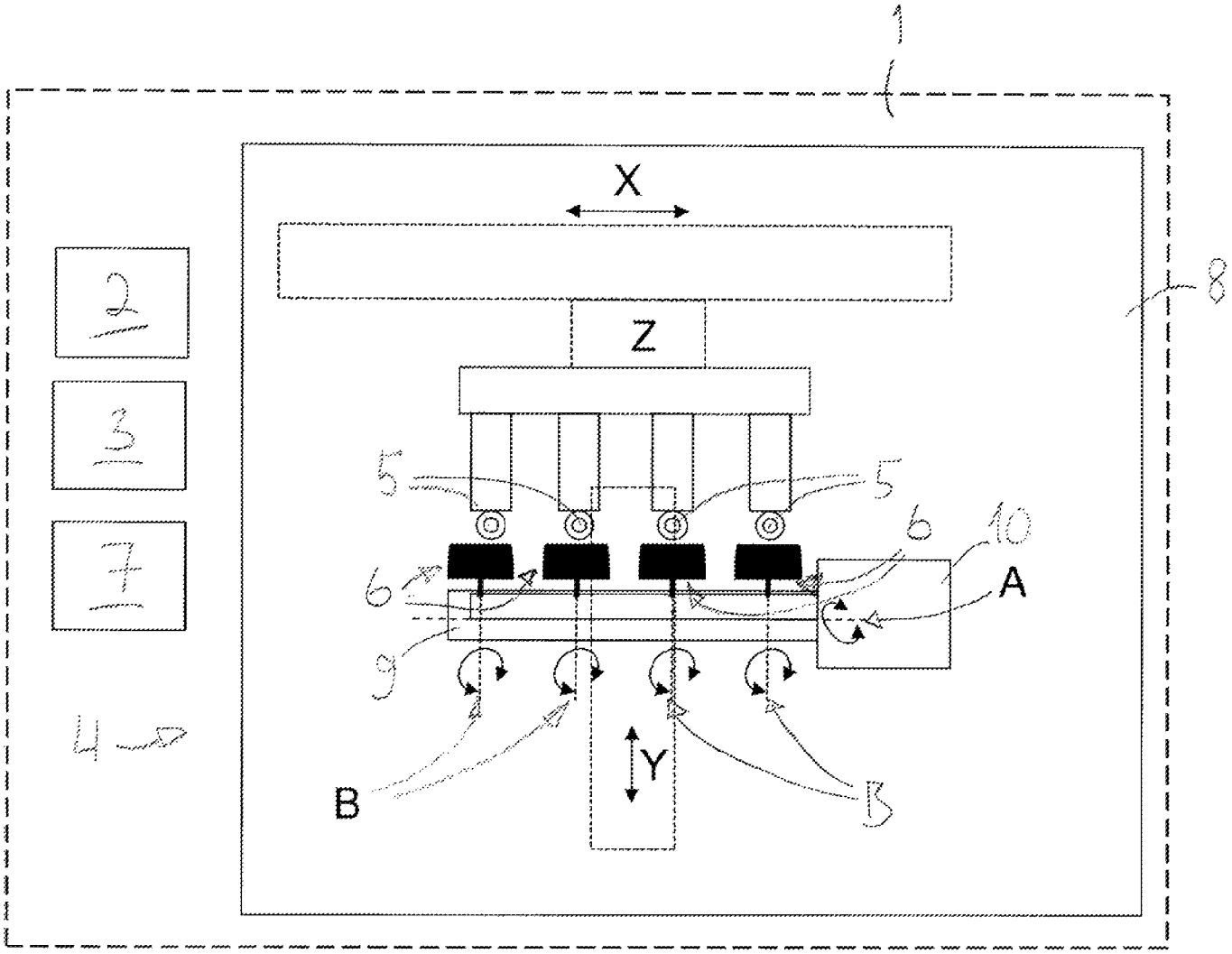
FIG. 1 is a schematic view of an example apparatus and method.

FIG. 1 is a schematic view of an example apparatus and method. The apparatus 1 may comprise a CNC system 2 including hardware and software, a user interface 3, a motion control module 4, multiple dispense heads 5 and multiple fixtures 6 for holding parts arranged in a single motion platform 8. The motion platform 8 contains all of the motion parts of the apparatus.

The embodiment shown in FIG. 1 comprises four dispense heads 5 and four fixtures 6. It is to be noted, however, that the number of dispense heads 5 and fixtures 6 may be two or more. In an embodiment of the apparatus there are two or more fixtures 6 per one dispense head 5, e.g. four fixtures 6 and two dispense heads 5. The heads work two parts and then moves to work the next two parts.

The motion control module 4 may comprise a CNC motion control system 7 that comprises a set of three orthogonal, i.e. X-Y-Z, linear stages and two rotational axes A and B. This means that the motion control module 4 is arranged to realize automated motions of the dispense heads 5 relative to the fixtures 6. Said motions comprises three orthogonally X-Y-Z arranged linear motions and first and second rotational motions, the rotation axis A of the first rotational motion being divergent from the rotation axis B of the second rotational motion. The motion control module 4 comprises also all the necessary amplifiers, motors, position feedback controls etc.

The apparatus 1 allows the use of the multiple dispense heads 5 to be manipulated in full 5 axes of motion relative to the articles being processed in a single motion platform 8.

It is to be noted that in this description said X and Y directions are in the plane of the Figures, and Z direction perpendicular to the plane of the Figures.

The dispense head 5 comprises one or more means selected from the group consisting of print devices, post processing devices and preprocessing devices. The dispense head 5 may be any means that is able to dispense substance and/or energy on the article.

The print device may be e.g. an ink jet device, an aerosol jet device, piezo valve jet or other material jetting device, and syringe, screw fed or other material spraying or dispensing device.

The post processing device may be e.g. a laser emitting head, a pulsed light emitting head, a light beam emitting head, a DC or AC electrical sintering head, a microwave sintering head, a plasma sintering head or ultra violet light head.

The pre-processing device may be e.g. a plasma cleaning device, a laser cleaning device etc. for treating the surface prior to the printing step.

The fixture 6 comprises means for holding or securing an article to be processed. The function of said means may be based on a mechanism, a suction cup, vacuum, clamping, magnetism, etc.

The article may be e.g. a part of a mobile phone, some other portable or fixedly positioned communication means such as a communicator, or some other portable electronic device, such as a palmtop computer, tablet computer, portable computer, game console or controller, playback device for audio and/or visual material, pulse counter, code reader, shaver, transmitter and/or receiver intended for measuring purposes, or a component of a vehicle, medical device, or any part from any industry.

The material of the article may comprise plastic, metal, glass, ceramics, composite, stone, wood etc.

The multiple fixtures 6 are arranged to a slave unit 9 that realizes at least one of said two rotational movements so that the multiple fixtures 6 therein realize simultaneously and equally said rotational motion. The dispense heads 5 are arranged to move in X-axis and Z-axis directions relative to the motion platform 8.

According to another embodiment, the multiple dispense heads 5 are arranged to a slave unit 9 that realizes at least one of said two rotational movements so that the dispense heads 5 therein realize simultaneously and equally said rotational motion, whereas the multiple fixtures 6 are arranged to move in X-axis and Z-axis directions with respect to the motion platform 8.

The articles to be processed are loaded manually or automatically into the apparatus 1 and held in the fixtures 6 during the processing.

The slave unit 9 of the embodiment of the apparatus shown in FIG. 1 is supported by a master unit support 10 that is arranged movably in Y-axis direction relative to the dispense heads 5. Thus all the fixtures 6 are able to move in Y-axis direction together with the master unit support 10. An embodiment of the slave unit 9 and the master unit 10 is shown in FIG. 5.

All linear movements described herein may be realized by linear motors, linear stages, guide bars etc.

The motion control module 4 may thus realize X-Y-Z linear motions and two rotational motions A, B and manipulates the articles relative to the dispense heads 5 according to the programmed CAD/CAM data for depositing the functional material and/or conducting pre-processing and/or post-processing operations as required.

According to another embodiment of the invention the motion control module 4 is capable to realize an additional sixth movement, i.e. third rotational movement, rotational axis C of which may be orthogonal to first and second rotational axis A, B. In the embodiment shown in FIG. 1, for instance, the dispense heads 5 could tilt or rotate around their axis in Y-direction.

Figure 2:
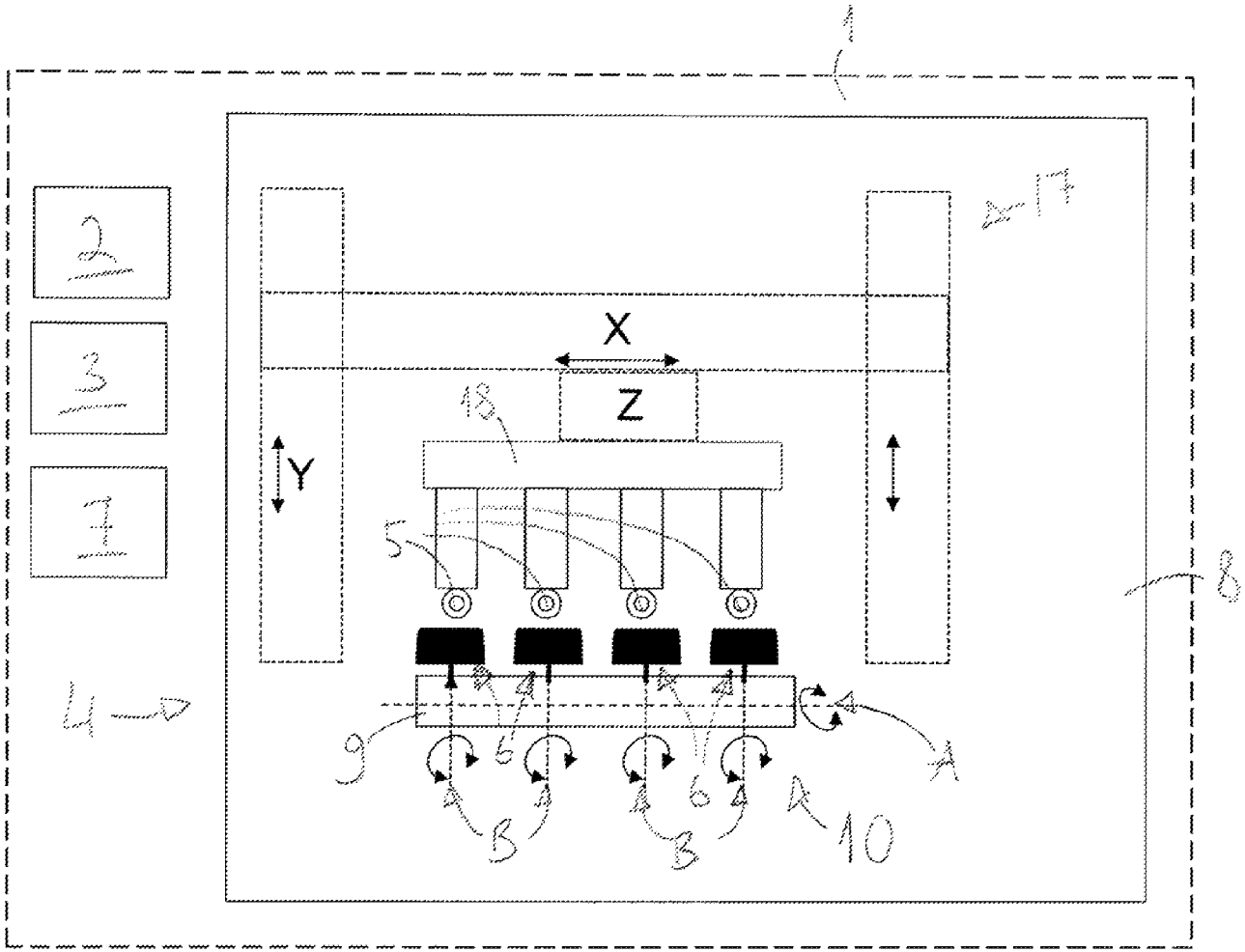
FIG. 2 is a schematic view of another example apparatus and method.

FIG. 2 is a schematic view of another example apparatus and method.

The slave unit 9 is arranged to implement the first rotational movement around first rotation axis A arranged in X-axis direction, whereas fixtures 6 attached to the slave unit 9 implement second rotational movement around second rotation axes B as described already in context with. FIG. 1.

There are two main differences compared to the embodiment shown in FIG. 1. First difference is that the master unit support 10 is stationary respect to the motion platform 8. The dispense heads 5 are arranged to a dispense head support 18 that is able to move in linear X-Y-Z-directions.

Second difference is that the linear motions in X-Y-Z directions are implemented by a gantry structure 17.

Motions in X and Z directions are implemented by means carried by the gantry structure 17.

Figure 3:
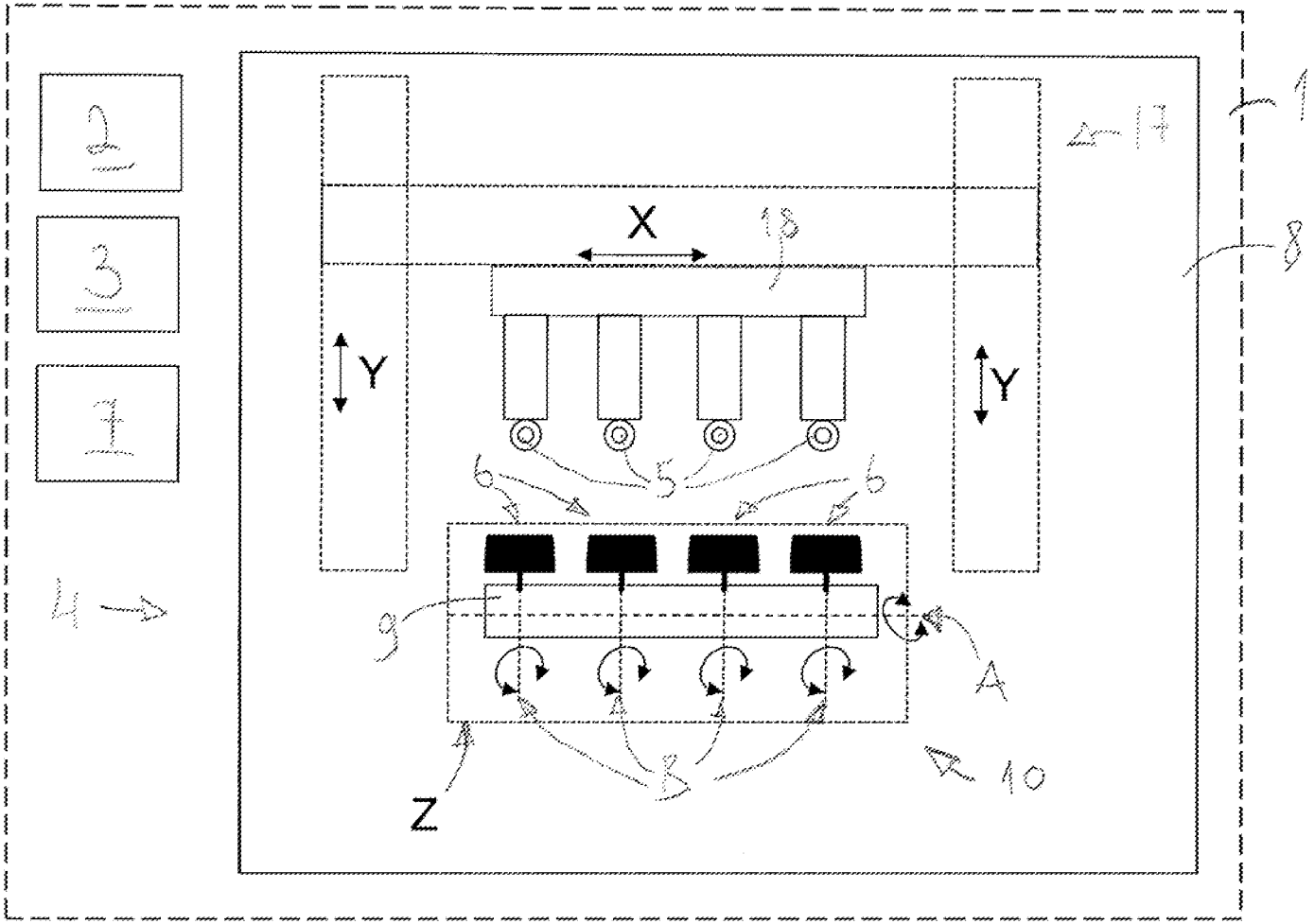
FIG. 3 is a schematic view of a third example apparatus and method.

FIG. 3 is a schematic view a third example apparatus and method.

Fixtures 6 are arranged to a slave unit 9. Each of the fixtures 6 are able to rotate around a second rotation axis B of its own.

The slave unit 9 is attached to a master unit support 10 and is able to rotate around first rotation axis A arranged in X-axis direction.

The master unit support 10 and fixtures 6 therewith are adapted to move in Z-axis direction.

Dispense heads 5 are fitted in a dispense head support 18 that is arranged to move in X-axis and Y-axis directions in a gantry structure 17.

Figure 4:
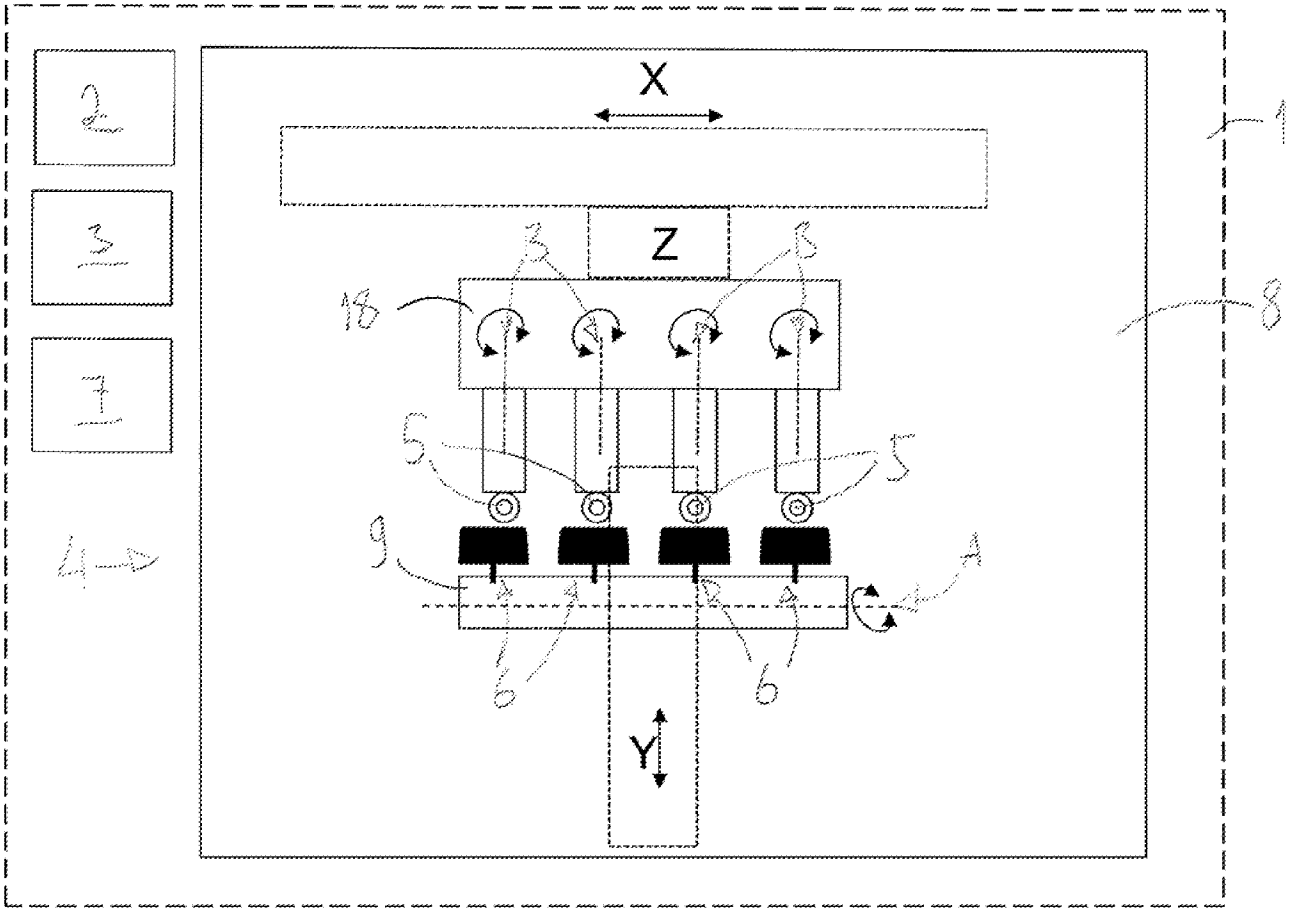
FIG. 4 is a schematic view of a fourth example apparatus and method.

FIG. 4 is a schematic view of a fourth example apparatus and method.

In this embodiment the slave unit 9 is arranged to the master unit support 10 which is adapted to move in Y-axis direction. The slave unit 9 is arranged to implement a first rotational movement around first rotation axis A arranged in X-axis direction.

Fixtures 6 are arranged to the slave unit 9 parallelly and nonrotatably, i.e. the slave unit 9 implements only the first rotational movement around first rotation axis A.

Dispense heads 5 are fitted to a dispense head support 18 that is arranged to move linearly in X-axis and Z-axis directions.

Each of the dispense heads 5 is able to rotate around second rotation axis B of its own. The second rotation axes B are parallelly arranged in the dispense head support 18 and are perpendicular to the first rotation axis A.

Figure 5A:
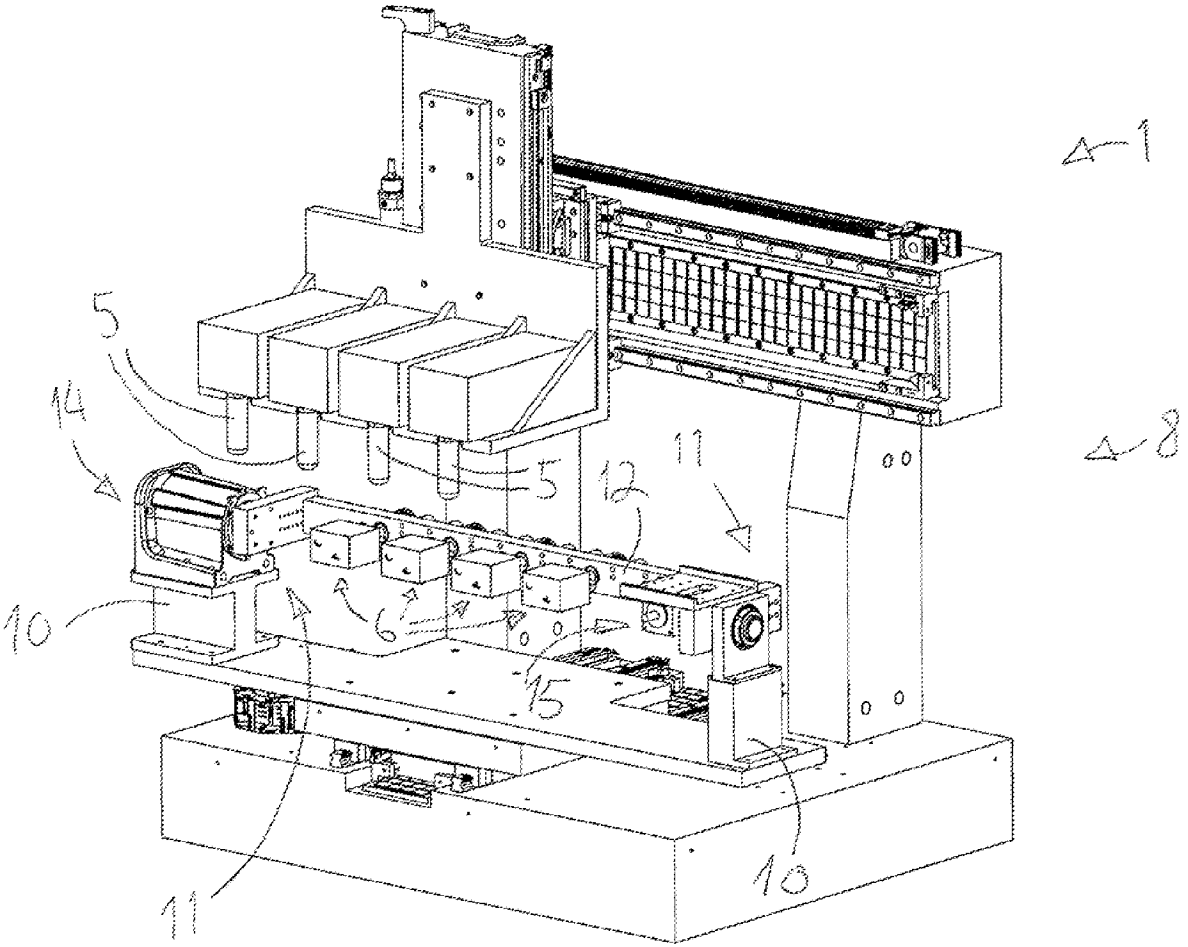
FIG. 5*a* is a schematic perspective view of an example slave unit.
Figure 6B:
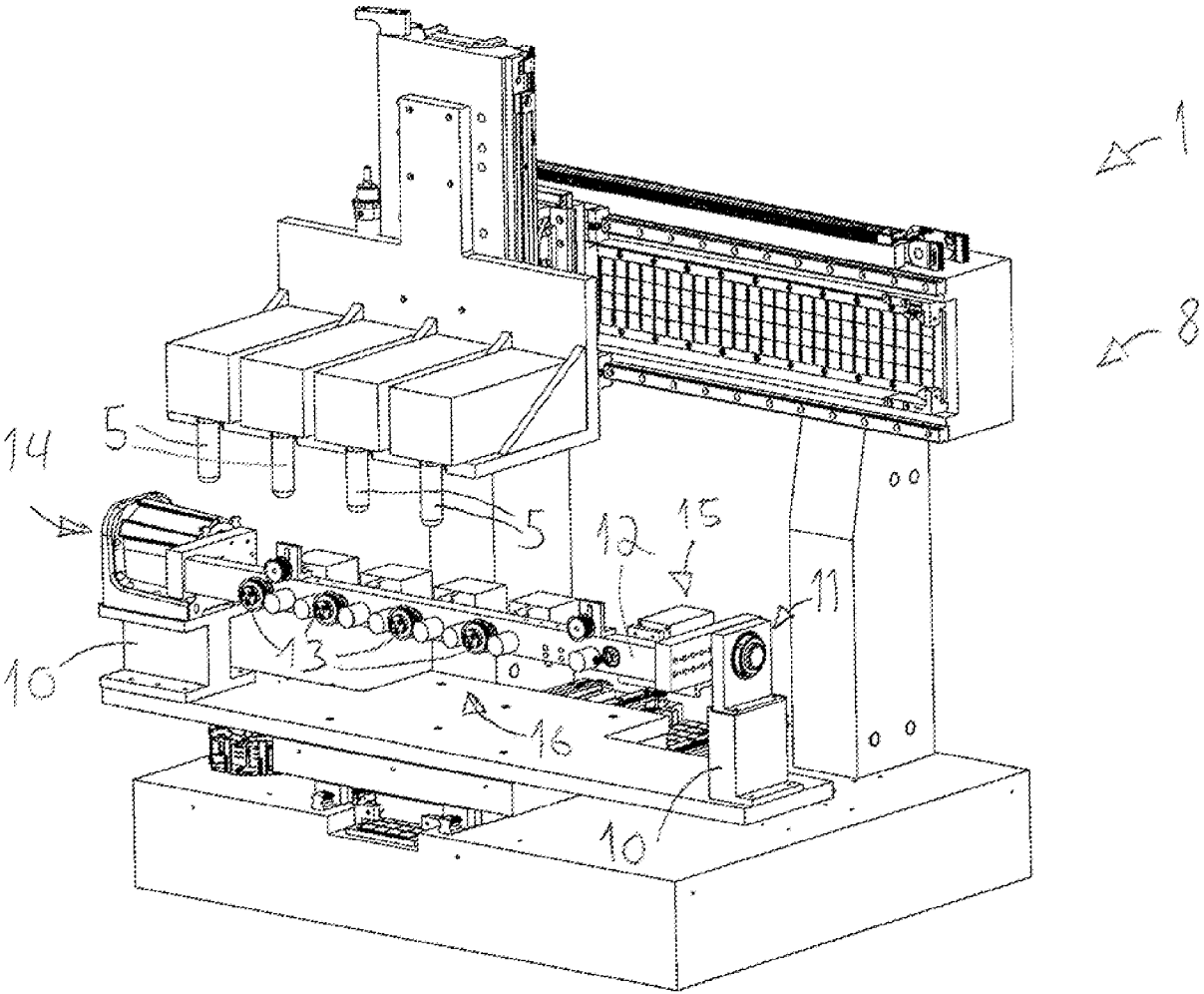

FIG. 5*a* is a schematic perspective view of an example slave unit, and FIG. 5*b* is another schematic perspective view of the example slave unit shown in FIG. 5*a*. The slave unit 9 and the fixtures 6 therewith are able to rotate around first rotation axis A arranged in X-axis direction. For this purpose the slave unit 9 is attached to the master unit support 10 by at least one hinge 11.

The slave unit 9 comprises also a crank 12 that is rotatable around the hinges 11. The fixtures 6 are attached to the crank 12 by fixture axes 13 being parallelly arranged and perpendicular to the first rotation axis A. As the slave unit 9 rotates around the first rotational axis A, all the fixtures also do so. The crank 12 can be rotated with a first motor 14, which is e.g. an electric motor. The first motor 14 may also contain a gear box.

FIG. 5*b* is showing the slave unit 9 rotated about 180° around first rotation axis A compared to the position of the slave unit 9 in FIG. 5*a*.

Each of the fixtures 6 can rotate around a second rotation axis B that is concentric with the respective fixture axis 13. These rotational motions of the fixtures 6 are generated by a second motor 15 that is attached to and rotating with the crank 12. In other words, the fixtures 6 are adapted to be driven with one and the same motor.

The fixtures 6 are joined to the first motor 14 by transmission means 16, e.g. by belt(s), gear(s), rack and pinion and/or chain(s). The second motor 14 and/or fixtures 6 may also contain a gear box.

According to another embodiment, the fixtures arranged to the slave unit 9 are each adapted to be driven with individual motors. That means in case of the embodiment shown in FIG. 5 that there would be four second motors, each of which rotating one of the fixtures 6. According to still another embodiment, there may be multiple first motors each of which are running two or more fixtures 6.

The range of the first and second rotational motions may be limited, e.g. ±45° (or 90°) or ±270° from an extreme position to another extreme position, or they may rotate infinitely in both directions. The first and second rotational motions may take place in both directions, i.e. clockwise and counter clockwise.

According to another embodiment, the dispense heads 5 and the fixtures 6 have been transposed, i.e. the slave unit 9 comprises multiple dispense heads 5 instead of the fixtures 6.

The apparatuses 1 described above in this description may be used for conducting a method for 3D dispensing, in which method:

- dispense media is dispensed simultaneously on at least two articles by using at least two dispense heads on a motion platform,
- said dispense heads are moved relative to said articles by automatically controlled motions, wherein
- said motions comprises three orthogonally X-Y-Z arranged linear motions and first and second rotational motions, the rotation axis of the first rotational motion being divergent from the rotation axis of the second rotational motion, and
- said motions are realized simultaneously and equally for producing said simultaneous dispensing of the dispense media.

The apparatus and method may be used for dispensing, and/or preprocessing and/or post-processing functional and decorative inks on multiple faces or surface features of three dimensional articles. The functionality of the ink may relate to electrical, sensing, decorative or other functions.

The invention is not limited solely to the embodiments described above, but instead many variations are possible within the scope of the inventive concept defined by the claims below. Within the scope of the inventive concept the attributes of different embodiments and applications can be used is in conjunction with or replace the attributes of another embodiment or application.

The drawings and the related description are only intended to illustrate the idea of the invention. The invention may vary in detail within the scope of the inventive idea defined in the following claims.

REFERENCE SYMBOLS

1 apparatus
2 CNC system
3 user interface
4 motion control module
5 dispense head
6 fixture
7 CNC motion control system
8 motion platform
9 slave unit
10 master unit support
11 hinge
12 crank
13 fixture axle
14 first motor
15 second motor
16 transmission means
17 gantry structure
18 dispense head support
X, V, Z direction of linear motion
A, B, C rotational axis

The invention claimed is:

1. A 3D dispensing apparatus comprising:
a motion platform;
at least two dispense heads configured to dispense;
multiple fixtures configured to hold articles to be processed simultaneously; and
a motion control module configured to automatically move the dispense heads and the fixtures relative to one another, wherein
the movements comprise three orthogonally X-Y-Z arranged linear motions and first and second rotational motions, the rotational axis of the first rotational motion being orthogonal to the rotational axis of the second rotational motion,
the dispense heads or the fixtures being arranged to a slave unit, and
the slave unit being arranged to realize at least one of the first and second rotational movements so that the dispense heads or the fixtures thereto realize simultaneously and equally the same at least one of the first and second rotational motions.

2. The apparatus as claimed in claim 1, wherein
the slave unit is arranged in a master unit support arranged movably in the Y-axis direction,
the slave unit configured to realize the first rotational movement around a first rotational axis arranged in the X-axis direction,
each of the fixtures being arranged to the slave unit rotatable around a second rotational axis of its own, the second rotational axes being parallelly arranged and perpendicular to the first rotational axis, and
the dispense heads arranged movably in the X-axis and the Z-axis directions with respect to the motion platform.

3. The apparatus as claimed in claim 1, wherein
the slave unit is arranged to a master unit support configured to be stationary to the platform, the slave unit is arranged to realize the first rotational movement around a first rotational axis arranged in the X-axis direction, each of the fixtures are arranged to the slave unit rotatable around a second rotational axis of its own, the second rotational axes being parallelly arranged and perpendicular to the first rotational axis, the dispense heads are arranged in a dispense head support configured to move in the Y-axis direction, and the dispense head support comprising means for moving the dispense heads in the X-axis and the Z-axis directions.

4. The apparatus as claimed in claim 1, wherein the fixtures being arranged to the slave unit rotatable around a second rotational axis of its own, the second rotational axes being parallelly arranged and perpendicular to the first rotational axis in the X-axis direction, the slave unit configured to rotate the fixtures around a first rotational axis arranged in the X-axis direction, the slave unit arranged to a master unit support adapted to move in the Z-axis direction, and the dispense heads fitted in a dispense head support and arranged to move therewith in the X-axis and the Y-axis directions.

5. The apparatus as claimed in claim 1, wherein the slave unit is arranged to a master unit support adapted to move in the Y-axis direction, the slave unit is arranged to realize the first rotational movement around a first rotational axis arranged in the X-axis direction, the fixtures are arranged to the slave unit parallelly and nonrotatably, the dispense heads are fitted to a dispense head support that is arranged to move in the X-axis and the Z-axis directions, and each of the dispense heads being arranged to the slave unit rotatable around a second rotational axis of its own, the second rotational axes.

6. The apparatus as claimed in claim 1, wherein the dispense heads or the fixtures arranged to the slave unit are configured to be driven with one and the same motor.

7. The apparatus as claimed in claim 6, wherein the dispense heads or fixtures are joined to the motor by transmission means comprising at least one of a belt, a gear, a rack and pinion system and a chain.

8. The apparatus as claimed in claim 1, wherein the dispense heads or the fixtures arranged to the slave unit are each configured to be driven with individual motors.

9. The apparatus as claimed in claim 1, wherein the number of the dispense heads or the fixtures is four.

10. The apparatus as claimed in claim 6, wherein the number of the dispense heads or the fixtures is four.

11. The apparatus as claimed in claim 7, wherein the number of the dispense heads or the fixtures is four.

12. The apparatus as claimed in claim 8, wherein the number of the dispense heads or the fixtures is four.

13. The apparatus as claimed in claim 1, wherein the motion control module comprises means for third rotational movement as a sixth movement.

14. The apparatus as claimed in claim 6, wherein the motion control module comprises means for third rotational movement as a sixth movement.

15. The apparatus as claimed in claim 7, wherein the motion control module comprises means for third rotational movement as a sixth movement.

16. The apparatus as claimed in claim 8, wherein the motion control module comprises means for third rotational movement as a sixth movement.

17. The apparatus as claimed in claim 1, wherein the dispense head comprises one or more means selected from the group consisting of print devices, post processing devices and pre-processing devices.

18. The apparatus as claimed in claim 17, wherein the dispense head is a print device, and the print device is selected from the group consisting of jetting devices such as ink jet devices, aerosol jet devices, piezo valve jet devices, and dispensing devices such as syringe devices, screw fed devices and spraying devices.

19. The apparatus as claimed in claim 17, wherein the dispense head is a processing device, and the post processing device is selected from the group consisting of laser emitting heads, pulsed light emitting heads, light beam emitting heads, DC or AC electrical sintering heads, microwave sintering heads, plasma sintering heads and ultra violet light heads.

20. The apparatus as claimed in claim 17, wherein the dispense head is a pre-processing device, and the pre-processing device is selected from the group consisting of plasma cleaning devices and laser cleaning devices.

21. The apparatus as claimed in claim 1, wherein the three orthogonally X-Y-Z arranged linear motions and the first and second rotational motions are each controlled independently.

* * * * *